US009938974B2

(12) United States Patent
Swartzlander

(10) Patent No.: US 9,938,974 B2
(45) Date of Patent: Apr. 10, 2018

(54) SUPERCHARGER ASSEMBLY WITH ROTOR END FACE SEAL AND METHOD OF MANUFACTURING A SUPERCHARGER ASSEMBLY

(71) Applicant: EATON CORPORATION, Cleveland, OH (US)

(72) Inventor: Matthew G. Swartzlander, Battle Creek, MI (US)

(73) Assignee: EATON CORPORATION, Cleveland, OH (US)

( * ) Notice: Subject to any disclaimer, the term of this patent is extended or adjusted under 35 U.S.C. 154(b) by 477 days.

(21) Appl. No.: 14/580,879

(22) Filed: Dec. 23, 2014

(65) Prior Publication Data

US 2015/0110610 A1 Apr. 23, 2015

Related U.S. Application Data

(63) Continuation of application No. PCT/US2013/046088, filed on Jun. 17, 2013.
(Continued)

(51) Int. Cl.
*F04C 27/00* (2006.01)
*F04C 18/16* (2006.01)
(Continued)

(52) U.S. Cl.
CPC ..... *F04C 18/16* (2013.01); *F02B 33/00* (2013.01); *F04C 27/005* (2013.01);
(Continued)

(58) Field of Classification Search
CPC .... F04C 27/009; F04C 18/16; F04C 2240/56; F04C 27/005; F01C 19/005
See application file for complete search history.

(56) References Cited

U.S. PATENT DOCUMENTS 2,393,116 A 1/1946 McCulloch et al.
2,491,678 A 12/1949 McCulloch et al.
(Continued)

FOREIGN PATENT DOCUMENTS

DE 27 00 226 A1 7/1978
EP 1 236 903 A2 9/2002
(Continued)

OTHER PUBLICATIONS

Machine translation of German Patent Publication DE 2700226 A1 (applicant: Pfeiffer, Vakuumtechnik), German patent publication date: Jul. 6, 1978.*
(Continued)

*Primary Examiner* — Mary A Davis
(74) *Attorney, Agent, or Firm* — Merchant & Gould P.C.

(57) ABSTRACT

A supercharger assembly has a rotor housing defining a chamber. A rotor is within the chamber and has an end with an end face. A seal has a seal face adjacent the end face. The seal face and the end face have complex topographies configured to be complementary to define a gap therebetween. The complex topographies can be, but are not limited to, interfitting concentric annular channels. The gap functions as a tortuous flow path to inhibit fluid flow past the end face. A method of manufacturing a supercharger assembly is also provided.

29 Claims, 3 Drawing Sheets

Related U.S. Application Data

(60) Provisional application No. 61/665,969, filed on Jun. 29, 2012.

(51) Int. Cl.
*F01C 19/00* (2006.01)
*F02B 33/00* (2006.01)

(52) U.S. Cl.
CPC ..... *F01C 19/005* (2013.01); *F04C 27/009* (2013.01); *F04C 2240/56* (2013.01); *Y10T 29/49236* (2015.01)

(56) References Cited

U.S. PATENT DOCUMENTS

| | | | | |
|---|---|---|---|---|
| 2,492,935 | A | 12/1949 | McCulloch et al. | |
| 3,359,953 | A | 12/1967 | Groth | |
| 3,372,906 | A | 3/1968 | Griffith | |
| 4,242,065 | A | 12/1980 | Ishizuka et al. | |
| 4,369,020 | A | 1/1983 | Rahnke | |
| 4,422,836 | A | 12/1983 | Meyman | |
| 5,209,636 | A | 5/1993 | Fannar | |
| 5,335,640 | A | 8/1994 | Feuling | |
| 5,902,546 | A * | 5/1999 | Kawasetsu | B21K 1/36 148/437 |
| 6,682,077 | B1 * | 1/2004 | Letourneau | F01D 1/36 277/409 |
| 7,192,262 | B2 | 3/2007 | Rippl et al. | |
| 9,133,725 | B2 * | 9/2015 | Wiebe | F01D 11/02 |

FOREIGN PATENT DOCUMENTS

| | | | |
|---|---|---|---|
| JP | 07317553 | A * | 12/1995 |
| JP | 2009-275567 | A | 11/2009 |

OTHER PUBLICATIONS

International Search Report for corresponding International Patent Application No. PCT/US2013/046088 dated Mar. 6, 2014.

* cited by examiner

SUPERCHARGER ASSEMBLY WITH ROTOR END FACE SEAL AND METHOD OF MANUFACTURING A SUPERCHARGER ASSEMBLY

CROSS-REFERENCE TO RELATED APPLICATION

This application is a Continuation Application of PCT/US2013/046088 filed on 17 Jun. 2013, now published application WO2014/004141, published on Jan. 3, 2014, which claims benefit of U.S. Patent Application Ser. No. 61/665,969 filed on 29 Jun. 2012, and which applications are incorporated herein by reference. To the extent appropriate, a claim of priority is made to each of the above disclosed applications.

TECHNICAL FIELD

The present teachings generally include a supercharger assembly having a rotor with an end face.

BACKGROUND

Energy efficient engines of reduced size are desirable for fuel economy and cost reduction. Smaller engines provide less torque than larger engines. A supercharger assembly is sometimes used to increase the torque available from an engine. At low engine speeds, when higher torque is requested by a vehicle operator by depressing the accelerator pedal, the supercharger assembly provides additional air to the engine intake manifold, boosting air pressure and thereby allowing the engine to generate greater torque at lower engine speeds.

Assembling the supercharger assembly typically requires that a gap remain between the end faces of the rotors and an end portion or bearing plate of the supercharger housing in order to accommodate the stack-up of manufacturing tolerances of the components, as well as to accommodate thermal growth of the components that occurs during usage of the supercharger assembly. Leakage of air past the rotors, such as through the gap at the end faces, especially at low rotational speeds, can significantly reduce the ability of the supercharger assembly to provide engine boost.

SUMMARY

A supercharger assembly is provided that has a rotor housing defining a chamber. A rotor is within the chamber and has an end with an end face. A seal has a seal face adjacent the end face. The seal face and the end face have nonplanar topographies configured to be complementary to define a gap therebetween. The nonplanar topographies can be, but are not limited to, interfitting concentric annular ridges and channels. The gap between the seal face and the end face functions as a tortuous flow path to inhibit fluid leakage through the chamber past the end face. The increased turbulence through the tortuous flow path should slow the air flow, thereby reducing leakage past the rotor end face and increasing the efficiency of the supercharger assembly in comparison to supercharger assemblies that do not have end faces and seal faces with complementary, nonplanar topographies.

A method of manufacturing a supercharger assembly includes machining annular concentric channels in an end face of a rotor and fitting a rotor shaft through a center of the rotor so that a portion of the rotor shaft extends past the end face. A bearing is placed into an annular seal that has a seal face with annular ridges. The seal with the bearing therein is then pressed into the end portion of a rotor housing. The method includes sliding the rotor shaft into the bearing so that the annular ridges of the end face fit within the annular concentric channels of the seal face and the seal face and the end face define a gap therebetween. The gap functions as a tortuous flow path to inhibit fluid leakage past the end face.

The above features and advantages and other features and advantages of the present teachings are readily apparent from the following detailed description of the best modes for carrying out the present teachings when taken in connection with the accompanying drawings.

DETAILED DESCRIPTION

Figure 1:
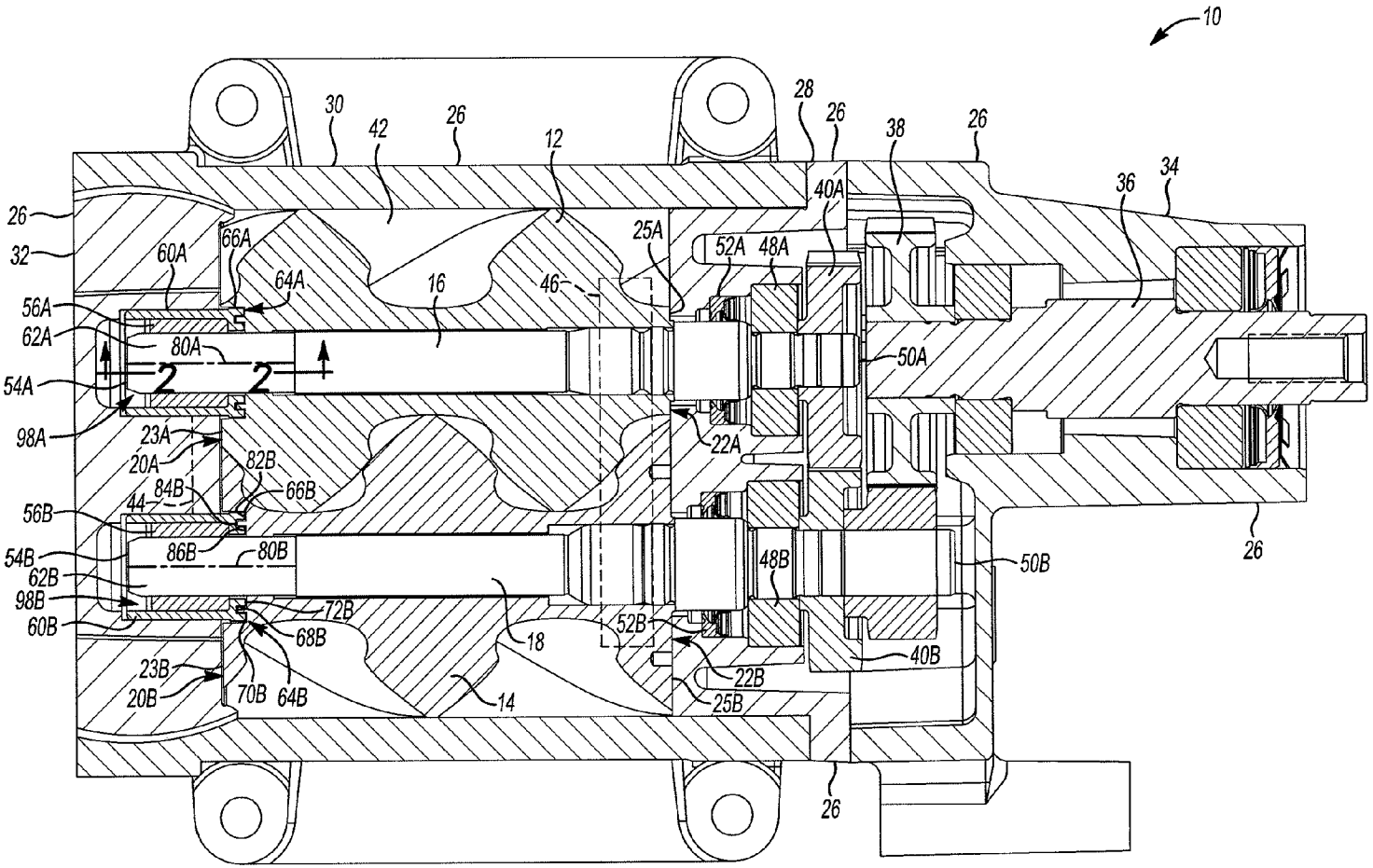
FIG. 1 is a schematic illustration in partial cross-sectional view of a supercharger assembly taken lengthwise through the supercharger assembly.

Referring to the drawings, wherein like reference numbers refer to like components throughout the several views, FIG. 1 shows a supercharger assembly 10. In this embodiment, the supercharger assembly 10 can be a positive displacement rotary blower or a compressor for an engine, such as a screw compressor, or may be used to pump other fluids and in other applications. The supercharger assembly 10 has a first rotor 12 that meshes with a second rotor 14. Each of the rotors 12, 14 has multiple lobes. The first rotor 12 is mounted on and rotates with a first rotor shaft 16. The second rotor 14 is mounted on and rotates with a second rotor shaft 18 that is generally parallel with the first rotor shaft 16. Each of the rotors 12, 14 can have four lobes, although a different number of lobes such as three or five lobes can instead be used. Each of the lobes of rotor 12 is helically twisted in a counterclockwise direction along the length of the rotor 12 from a first rotor end face 20A to a second rotor end face 22A at opposite first and second axial ends 23A, 25A of the rotor 12, as is apparent in FIG. 4. Similarly, rotor 14 has multiple lobes, but the lobes of rotor 14 are helically twisted in a clockwise direction to mesh with the lobes of rotor 12. The lobes of rotor 14 extend from a first rotor face 20B to a second rotor face 22B at opposite first and second axial ends 23B, 25B of the rotor 14.

The rotors 12, 14 and rotor shafts 16, 18 are contained within a multi-component housing 26. The housing 26 includes a front cover 28, a midportion 30 that can be referred to as a rotor housing portion, an end portion 32 that can be referred to as a bearing plate, and a drive shaft cover portion 34. The front cover 28 and the end portion 32 are fastened with bolts or otherwise secured to the midportion 30.

An input shaft 36 that can be powered by an engine crankshaft directly or through other gears is connected through a flexible coupling 38 to a first gear 40A that rotates with the first rotor shaft 16. The first gear 40A meshes with a second gear 40B mounted to rotate with the second rotor shaft 18.

Bearings 48A, 48B support the rotor shafts 16, 18 near the ends 50A, 50B of the rotor shafts in the front cover 28. Lip seals 52A, 52B surround the rotor shafts 16, 18 and help to enclose the rotors 12, 14. The rotor shafts 16, 18 are supported near opposite ends 54A, 54B in the end portion 32 by additional bearings 56A, 56B.

The midportion 30 defines a rotor cavity 42 through which the rotor shafts 16, 18 extend and in which the rotors 12, 14 rotate. A fluid such as air is driven by the rotating rotors 12, 14 through the rotor cavity 42 between the rotor housing 26 and the rotors 12, 14 from an inlet 44 to an outlet 46. The inlet 44 is in the end portion 32 below the rotor shafts 16 and 18 in FIG. 1 near the axial ends 23A, 23B of the rotors 12, 14 and is represented by a dashed line. The outlet 46 is in the midportion 30 (shown in hidden lines in FIG. 1) near the opposite ends 25A, 25B of the rotors 12, 14. In other embodiments, the inlet 44 and the outlet 46 could be located elsewhere in the rotor housing 26.

Air that passes from the air inlet 44 to the air outlet 46 along an unintended flow path, such as by passing between the mesh of the rotors 12, 14, or air that exits out of the rotor cavity 42 by passing back to the inlet 44 along first rotor end faces 20A, 20B of the rotors 12, 14 or along second rotor end faces 22A, 22B of the rotors 12, 14 is referred to as "leakage" that decreases the efficiency of the supercharger assembly 10.

Figure 2:
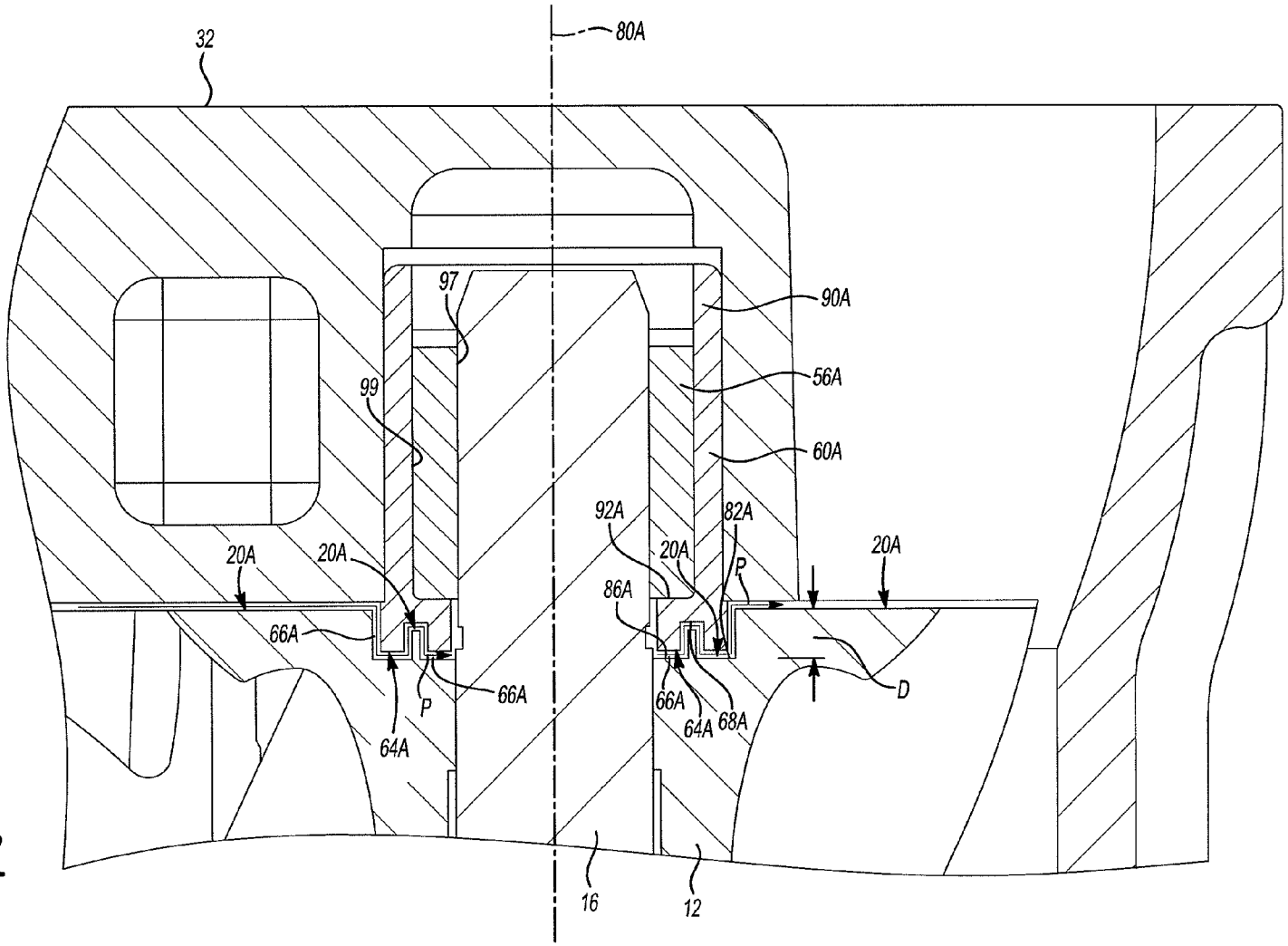
FIG. 2 is a schematic fragmentary cross-sectional illustration taken at lines 2-2 of FIG. 1 of a portion of the supercharger assembly of FIG. 1, showing a rotor face seal interfit with an end face of one of the rotors.

Referring to FIG. 2, in order to inhibit leakage at the rotor end faces 20A, 20B, seals 60A, 60B are provided that are concentric with and extend around portions 62A, 62B of the rotor shafts 16, 18 that extend out of the rotor cavity 42 beyond the rotor end faces 20A, 20B. Seal 60A has a seal face 64A that is adjacent the end face 20A of the rotor 12. Both the seal face 64A and the rotor end face 20A have nonplanar topographies that are configured to be complementary, i.e., to interfit, and define a gap 66A therebetween. That is, the seal 60A does not contact the end face 20A, but is spaced from the end face 20A by the gap 66A. Because of the complex topographies of the faces 64A, 20A, the gap 66A defines a tortuous flow path indicated by arrow P, inhibiting fluid leakage past the end face 20A. Less fluid will pass along the end face 20A than would be the case if the end face 20A were relatively planar. Accordingly, the gap 66A is sufficient to allow for both manufacturing tolerances of the components of the supercharger assembly 10 and thermal growth of the components of the supercharger assembly 10 while minimizing fluid leakage past the end face 20A.

Similarly, the seal 60B has a seal face 64B that is adjacent the end face 20B of the rotor 14. Both the seal face 64B and the end face 20B have nonplanar topographies that are configured to be complementary, i.e., to interfit, to define a gap 66B therebetween. That is, the seal 60B does not contact the end face 20B, but is spaced from the end face 20B by the gap 66B. Because of the nonplanar topographies of the faces 64B, 20B, the gap 66B defines a tortuous flow path, inhibiting fluid leakage past the end face 20B. Less fluid will pass along the end face 20B than would be the case if the end face 20B was planar. Accordingly, the gap 66B is sufficient to allow for both manufacturing tolerances of the components of the supercharger assembly 10 and thermal growth of the components of the supercharger assembly 10 while minimizing fluid leakage past the end face 20B.

Figure 3:
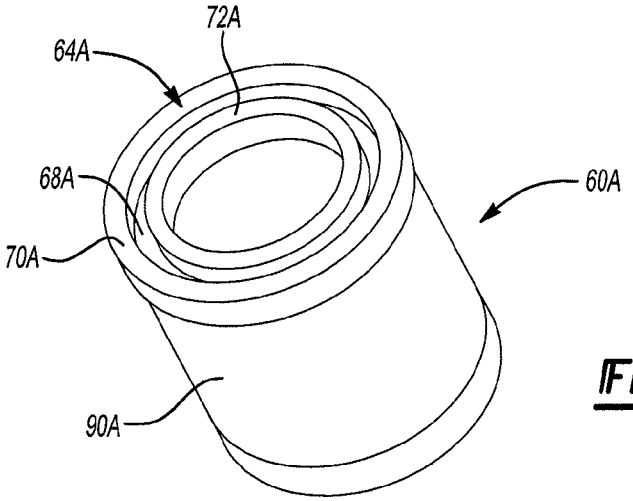
FIG. 3 is a schematic perspective illustration of the rotor face seal of FIG. 2.

Both the seal 60A and the seal 60B are configured identically. Accordingly, a detailed description of the seal 60A with respect to FIGS. 2 and 3 applies equally to seal 60B. FIG. 3 shows the nonplanar topography of the seal face 64A of the seal 60A. Specifically, the seal 60A has an annular channel 68A defined by a first annular ridge 70A and a second annular ridge 72A. The annular channel 68A, first annular ridge 70A and second annular ridge 72A are all at the seal face 64A and define part of the topography of the seal face 64A. Each of the annular channel 68A, first annular ridge 70A and second annular ridge 72A are concentric with the axis of rotation 80A of the rotor shaft 16 and rotor 12, as shown in FIG. 2. The seal 60A can be steel. The annular channel 68A of the seal 60A is referred to herein as a third annular channel.

Figure 4:
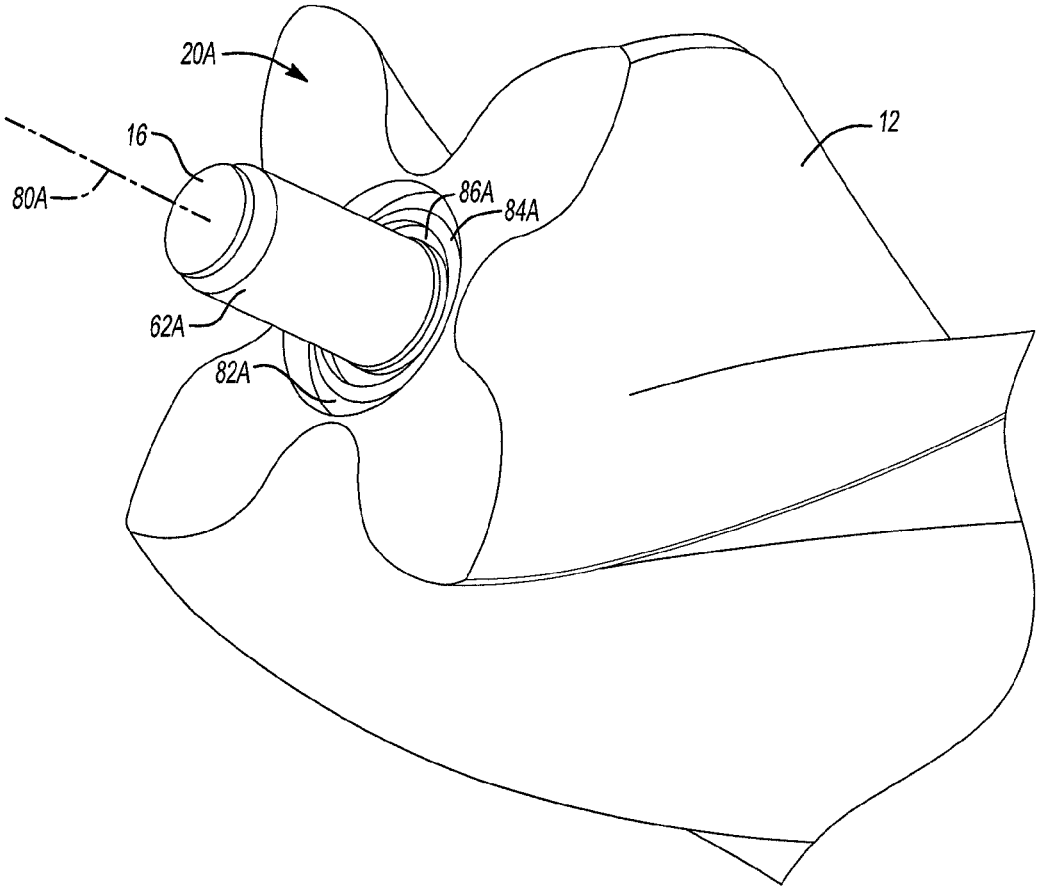
FIG. 4 is a schematic perspective illustration in fragmentary view of the end face of the rotor of FIG. 2 to which the rotor face seal interfits.

FIG. 4 shows the end face 20A of the rotor 12 with the portion 62A of the rotor shaft 16 extending beyond the end face 20A. The seal 60A of FIG. 1 is removed in FIG. 4 to reveal the end face 20A. The rotor 12 has a first annular channel 82A and a second annular channel 86A machined at the end face 20A to define an annular ridge 84A therebetween. Each of the first annular channel 82A, the second annular channel 86A, and the annular ridge 84A are at the end face 20A and define part of the topography of the end face 20A. Each of the first annular channel 82A, the second annular channel 86A, and the annular ridge 84A are concentric with the axis of rotation 80A of the rotor shaft 16 and rotor 12. The channels 82A, 86A can be of substantially equal depth D, as shown in FIG. 2. The end face 20A is uneven due to the channels 82A, 86A and the ridge 84A.

When portion 62A of the rotor shaft 16 is pressed into the bearing 56A in the end portion 32 of the rotor housing 26, the seal face 64A is adjacent the end face 20A with the gap 66A between the faces 64A, 20A so that the faces 64A, 20A do not contact one another. Due to the annular ridges 70A, 72A, and 84A and the annular channels 82A, 86A and 68A, the gap 66A creates a tortuous flow path indicated by arrow P in FIG. 2. That is, air flowing along the end face 20A, generally perpendicular to the axis of rotation 80A, would need to flow over and between the ridges 70A, 84A, and 72A, then around the rotor shaft 16, and then past the ridges 72A, 84A, 70A, in that order. Air passing along the face 20A will encounter the path P, slowing the flow of the air across the face 20A, and thus reducing flow. Although the tortuous flow path P is created by and between the annular ridges 70A, 72A, 84A, and channels 82A, 86A, 68A, the end face 20A and the seal face 64A could have different or additional nonplanar topographies to create a tortuous flow path.

As shown in FIG. 1, the seal 60B also has first and second axially extending ridges 70B, 72B, with an annular channel 68B therebetween. Each of the annular channel 68B, first annular ridge 70B and second annular ridge 72B are concentric with the axis of rotation 80B of the rotor shaft 18 and rotor 14. The rotor 14 has first and second annular channels 82B, 86B with an annular ridge 84B defined therebetween, all at the end face 20B and forming part of the topography of the end face 20B. Each of the first annular channel 82B, the second annular channel 86B, and the annular ridge 84B are concentric with the axis of rotation 80B of the rotor shaft 18 and rotor 14. The channels 82B, 86B can be of substantially equal depth D like channels 82A and 86A of FIG. 2. The seal 60B can be steel and the rotor 14 can be aluminum.

Referring again to FIG. 2, the seal 60A has an annular wall 90A that extends axially away from the first and second ridges 70A, 72A. The seal 60A also has a shoulder 92A extending radially inward and surrounded by the annular wall 90A. The bearing 56A is placed into the annular seal 60A so that the bearing 56A is seated at the shoulder 92A and is surrounded by the annular wall 90A. The shoulder 92A is radially inward of the annular wall 90A. The rotor shaft 16 is slid into the bearing 56A to fit to the bearing 56A at a central opening 97 of the bearing 56A. The rotor shaft 16 thereby also extends through a central opening 99 of the seal 60A. The end portion 32 of the housing 26 has a bearing cavity 98A sized to retain the seal 60A and the bearing 94A prior to the rotor shaft 16 being slid through the central opening 97.

The bearing 56B is placed into the seal 60B in a bearing cavity 98B and is configured in like manner as described with respect to the seal 60A. The bearing 56A and the bearing cavity 98A are configured the same as the bearing 56B and the bearing cavity 98B, respectively.

A method of manufacturing a supercharger assembly 10 includes machining annular concentric channels 82A, 86A in the end face 20A of the rotor 12, and then fitting the rotor shaft 16 through a center of the rotor 12 so that a portion 62A of the rotor shaft 16 extends past the end face 20A. An additional gear 40A and bearing 48A can be placed on an opposite end of the rotor shaft 16A. A bearing 56A is placed into the annular seal 60A, and the annular seal 60A with the bearing 56A therein is then pressed into the end portion 32 of the rotor housing 26. The rotor shaft 16 is then slid into the bearing 56A so that the annular ridges 70A, 72A fit within the annular concentric channels 82A, 86A and the seal face 64A and the end face 20A define a gap 66A therebetween. The gap 66A functions as a tortuous flow path to inhibit fluid leakage past the end face 20A.

The reference numbers used in the drawings and the specification along with the corresponding components are as follows:

10 supercharger assembly
12 first rotor
14 second rotor
16 first rotor shaft
18 second rotor shaft
20A, 20B first rotor face
22A, 22B second rotor face
23A, 23B first axial end
25A, 25B second axial end
26 housing
28 front cover
30 midportion
32 end portion
34 drive shaft cover portion
36 input shaft
38 flexible coupling
40A first gear
40B second gear
42 rotor cavity
44 inlet
46 outlet
48A, 48B bearing
50A, 50B end of rotor shaft
52A, 52B lip seal
54A, 54B end of rotor shaft
56A, 56B bearing
60A, 60B seal
62A, 62B portion of rotor shaft
64A, 64B seal face
66A, 66B gap
68A, 68B third channel
70A, 70B first annular ridge
72A, 72B second annular ridge
80A, 80B axis of rotation
82A, 82B first channel
84A, 84B third annular ridge
86A, 86B second channel
90A annular wall
92A shoulder
97 central opening of bearing
98A, 98B bearing cavity
99 central opening of annular seal
D depth
P tortuous flow path While the best modes for carrying out the many aspects of the present teachings have been described in detail, those familiar with the art to which these teachings relate will recognize various alternative aspects for practicing the present teachings that are within the scope of the appended claims.

The invention claimed is:

1. A supercharger assembly comprising:

a housing including a rotor housing portion defining a chamber;

a rotor within the chamber having an end with an end face, the rotor having an axis of rotation;

a seal being configured as a sleeve that mounts within a pocket of the housing, the sleeve including an annular wall defining a central opening that co-axially aligns with the axis of rotation of the rotor, the sleeve having a seal face that is defined by an axial end face of the sleeve; wherein the axial end face of the sleeve faces toward the end face of the rotor; and wherein the seal face and the end face of the rotor have nonplanar topographies configured to be complementary to define a gap therebetween; and a rotor bearing supporting a shaft of the rotor to permit rotation of the shaft relative to the housing, the rotor bearing being positioned within the central opening of the sleeve so as to be surrounded by the annular wall of the sleeve, the sleeve including an internal shoulder that opposes an axial end of the rotor bearing; and wherein the gap functions as a tortuous flow path to inhibit fluid flow therethrough.

2. The supercharger assembly of claim 1, further comprising:

a rotatable rotor shaft; wherein the rotor is mounted on and rotates with the rotor shaft; and the rotor bearing fit to the rotor shaft such that the rotor bearing is between the rotor shaft and the seal.

3. The supercharger assembly of claim 2, wherein the seal has a first axially-extending ridge and a second axially-extending ridge at the seal face with an annular channel therebetween, and the central opening is radially inward of the first axially-extending ridge;

wherein the rotor shaft extends through the central opening;

wherein the annular wall extends axially away from the first and second axially-extending ridges; wherein the internal shoulder is surrounded by the annular wall; and wherein the rotor bearing is seated at the internal shoulder within the central opening surrounded by the annular wall.

4. The supercharger assembly of claim 3, wherein the rotor housing portion is a midportion of the housing; and an end portion of the housing fits into the midportion of the housing and has a bearing cavity sized to retain the rotor bearing and the seal.

5. The supercharger assembly of claim 1, wherein the rotor has a first and a second annular channel at the end face and an annular ridge therebetween; and wherein the seal has a third annular channel at the seal face configured to receive the annular ridge of the rotor with the gap therebetween.

6. The supercharger assembly of claim 5, further comprising:

a rotatable rotor shaft; wherein the rotor is mounted on and rotates with the rotor shaft; and wherein the first, second, and third annular channels are concentric with the rotor shaft.

7. The supercharger assembly of claim 5, wherein the first annular channel and the second annular channel have a substantially equal depth.

8. The supercharger assembly of claim 1, wherein the seal is steel.

9. The supercharger assembly of claim 1, wherein the rotor is aluminum.

10. The supercharger assembly of claim 1, wherein the sleeve has an axial length that is longer than a corresponding axial length of the rotor bearing.

11. The supercharger assembly of claim 1, wherein at least one of the axial end face of the sleeve and the end face of the rotor includes a first non-planar topography that includes first and second annular ridges, and at least the other of the axial end face of the sleeve and the end face of the rotor defines a second non-planar topography that includes a third annular ridge.

12. The supercharger assembly of claim 11, wherein the first and second annular ridges surround the axis of rotation of the rotor and are separated by an annular channel.

13. The supercharger assembly of claim 12, wherein the third annular ridge is received within the annular channel between the first and second annular ridges.

14. The supercharger assembly of claim 11, wherein the first and second non-planar topographies cooperate to define at least a portion of the tortuous flow path.

15. The supercharger assembly of claim 1, wherein the bearing is held entirely within the sleeve.

16. A supercharger assembly comprising:

a housing including a rotor housing portion defining:

a chamber;

an inlet proximate a first end of the chamber; and an outlet proximate a second end of the chamber;

first and second rotor shafts;

a first and a second rotor within the chamber mounted on and configured to rotate with the first and the second rotor shafts, respectively; wherein the first and second rotors have end faces proximate the first end of the chamber; wherein the first and second rotor shafts extend axially through the first and second rotors, respectively, past the end faces;

wherein the end faces each have an uneven surface;

a first and a second rotor seal surrounding portions of the first and the second rotor shafts, respectively, that extend past the end faces; the first rotor seal being configured as a first sleeve that mounts within a first pocket of the housing, the first sleeve including an annular wall defining a first central opening that co-axially aligns with an axis of rotation of the first rotor, and the second rotor seal being configured as a second sleeve that mounts within a second pocket of the housing, the second sleeve including an annular wall defining a second central opening that co-axially aligns with an axis of rotation of the second rotor, the first sleeve having a first seal face that is defined by a first axial end face of the first sleeve, the second sleeve having a second seal face that is defined by a second axial end face of the second sleeve;

first and second bearings supporting first and second rotor shafts respectively to permit rotation of the first and second rotor shafts relative to the housing, the first and second bearings being respectively positioned within the first and second central openings of the first and second sleeves so as to be respectively surrounded by the annular walls of the first and second sleeves, the first and second sleeves each including an internal shoulder that respectively opposes an axial end of the first and second bearings;

wherein the first and second axial end faces of the first and second sleeves face toward the end faces of the first and second rotors, respectively, and wherein each of the first and second seal faces of the first and the second sleeves are configured to interfit with the uneven surface of the end faces of the first and second rotors, respectively, to define a gap between the uneven surface and the first and second seal faces; and wherein the gap functions as a tortuous flow path to inhibit fluid flow therethrough.

17. The supercharger assembly of claim 16, wherein each uneven surface has a first and a second annular channel with an annular ridge therebetween; and wherein each of the seal faces has a third annular channel configured to receive the annular ridge with the gap therebetween.

18. The supercharger assembly of claim 17, wherein the first, second, and third annular channels of the end face of the first rotor and the first rotor seal are concentric with the first rotor shaft; and wherein the first, second, and third annular channels of the end face of the second rotor and the second rotor seal are concentric with the second rotor shaft.

19. The supercharger assembly of claim 17, wherein the first annular channel and the second annular channel of each of the first and second rotors have a substantially equal depth.

20. The supercharger assembly of claim 17, wherein the first rotor seal has a first axially-extending ridge and a second axially-extending ridge with the third annular channel therebetween and the first central opening is positioned inward of the first axially-extending ridge;

wherein the annular wall of the first sleeve extends axially away from the first and second ridges; wherein the internal shoulder of the first sleeve is surrounded by the annular wall; and wherein the first bearing is seated at the internal shoulder of the first sleeve within the first central opening and surrounded by the annular wall of the first sleeve; and wherein the first bearing is configured to fit to the first rotor shaft.

21. The supercharger assembly of claim 20, wherein the internal shoulder of the first sleeve is radially inward of the annular wall; wherein the rotor housing portion is a midportion of the housing; and an end portion of the housing fits into the midportion of the housing and has a bearing cavity sized to retain the first bearing and the first rotor seal.

22. The supercharger assembly of claim 16, wherein the first rotor seal is steel.

23. The supercharger assembly of claim 16, wherein the first rotor is aluminum.

24. A method of manufacturing a supercharger assembly comprising:

machining annular concentric channels in an end face of a rotor;

fitting a rotor shaft through a center of the rotor so that a portion of the rotor shaft extends past the end face;

placing a bearing into an annular seal; wherein the seal has a seal face with annular ridges;

pressing the seal with the bearing therein into an end portion of a rotor housing;

sliding the rotor shaft into the bearing so that the annular ridges of the seal face fit within the annular concentric channels of the end face, and the seal face and the end face define a gap therebetween; and wherein the gap functions as a tortuous flow path to inhibit fluid flow past the end face.

25. The method of claim 24, further comprising:

fitting a gear to an opposing end of the rotor shaft prior to said sliding the rotor shaft into the bearing.

26. A supercharger assembly comprising:

a rotor housing defining a chamber;

a rotor within the chamber having an end with an end face;

a seal that has a seal face adjacent the end face, wherein the seal face and the end face have nonplanar topographies configured to be complementary to define a gap therebetween, and wherein the gap functions as a tortuous flow path to inhibit fluid flow past the end face;

a rotatable rotor shaft, wherein the rotor is mounted on and rotates with the rotor shaft; and a bearing fit to the rotor shaft such that the bearing is between the rotor shaft and the seal;

wherein the seal has a first axially-extending ridge and a second axially-extending ridge at the seal face with an annular channel therebetween, and has a central opening radially inward of the first axially-extending ridge;

wherein the rotor shaft extends through the central opening;

wherein the seal has an annular wall extending axially away from the first and second axially-extending ridges; wherein the seal has a shoulder surrounded by the annular wall; and wherein the bearing is within the central opening surrounded by the annular wall and seated at the shoulder.

27. The supercharger assembly of claim 26, wherein a midportion of the rotor housing defines the chamber; and an end portion of the rotor housing fits into the midportion of the rotor housing and has a bearing cavity sized to retain the bearing and the seal.

28. A supercharger assembly comprising:

a rotor housing defining:

a chamber;

an inlet proximate a first end of the chamber; and an outlet proximate a second end of the chamber;

first and second rotor shafts;

a first and a second rotor within the chamber mounted on and configured to rotate with the first and the second rotor shafts, respectively; wherein the first and second rotors have end faces proximate the first end of the chamber; wherein the first and second rotor shafts extend axially through the first and second rotors, respectively, past the end faces;

wherein the end faces each have an uneven surface;

a first and a second rotor seal surrounding portions of the first and the second rotor shafts, respectively, that extend past the end faces; and wherein each of the first and the second rotor seals has a seal face configured to interfit with the uneven surface of the first and the second end face, respectively, to define a gap between the uneven surface and the seal face; and wherein the gap functions as a tortuous flow path to inhibit fluid flow past the end face;

wherein each uneven surface has a first and a second annular channel with an annular ridge therebetween; and wherein each of the seal faces has a third annular channel configured to receive the annular ridge with the gap therebetween;

wherein the first rotor seal has a first axially-extending ridge and a second axially-extending ridge with the third annular channel therebetween and a central opening inward of the first axially-extending ridge;

wherein the first rotor seal has an annular wall extending axially away from the first and second ridges; wherein the first rotor seal has a shoulder surrounded by the annular wall; and further comprising:

a bearing seated at the shoulder within the central opening and surrounded by the annular wall; and wherein the bearing is configured to fit to the first rotor shaft.

29. The supercharger assembly of claim 28, wherein the shoulder is radially inward of the annular wall; wherein a midportion of the rotor housing defines the chamber; and an end portion of the rotor housing fits into the midportion of the rotor housing and has a bearing cavity sized to retain the bearing and the first rotor seal.

* * * * *